United States Patent [19]

Rice

[11] Patent Number: 4,836,538

[45] Date of Patent: Jun. 6, 1989

[54] EXERCISE MACHINE WITH NON-LINEAR HYDRAULIC RESISTANCE

[75] Inventor: Max Rice, Seattle, Wash.

[73] Assignee: The Max Rice Corporation, Seattle, Wash.

[21] Appl. No.: 89,483

[22] Filed: Aug. 25, 1987

[51] Int. Cl.[4] ..... A63B 23/02

[52] U.S. Cl. ..... 272/146; 272/130

[58] Field of Search ..... 272/130, 142, 146, 144, 272/134, 127, 33 R; 248/349

[56] References Cited

U.S. PATENT DOCUMENTS

| | | | |
|---|---|---|---|
| Re. 32,150 | 5/1986 | Rice . | |
| D. 231,242 | 4/1974 | Herrmann . | |
| 2,530,921 | 11/1950 | Tougas . | |
| 2,637,319 | 5/1953 | Bruene . | |
| 2,757,388 | 8/1956 | Chisholm . | |
| 3,100,639 | 8/1963 | Bonewitz . | |
| 3,384,369 | 5/1968 | Rumell . | |
| 3,441,271 | 4/1969 | Palacios . | |
| 3,511,500 | 5/1970 | Dunn | 272/130 X |
| 3,659,844 | 5/1972 | Cummins . | |
| 3,702,188 | 11/1972 | Phillips et al. | 272/130 |
| 3,756,592 | 9/1973 | Johnson . | |
| 3,784,193 | 1/1974 | Simjian . | |
| 3,841,627 | 10/1974 | Vetter . | |
| 3,911,907 | 10/1975 | Smith, Jr. . | |
| 3,936,047 | 2/1976 | Brandt et al. . | |
| 4,026,279 | 5/1977 | Simjian . | |
| 4,077,626 | 3/1978 | Newman . | |
| 4,132,405 | 1/1979 | Asher . | |
| 4,153,244 | 5/1979 | Tauber | 272/117 |
| 4,199,137 | 4/1980 | Giguere . | |
| 4,220,329 | 9/1980 | Agyagos . | |
| 4,249,725 | 2/1981 | Mattox | 272/117 |
| 4,305,579 | 12/1981 | Rice . | |
| 4,313,603 | 2/1982 | Simjian . | |
| 4,385,761 | 5/1983 | Rice . | |
| 4,391,441 | 7/1983 | Simjian . | |
| 4,436,513 | 3/1984 | Darby | 272/146 |
| 4,509,743 | 4/1985 | Lie . | |
| 4,538,807 | 9/1985 | Rice . | |
| 4,673,180 | 6/1987 | Rice . | |

FOREIGN PATENT DOCUMENTS

| | | | |
|---|---|---|---|
| 2631466 | 1/1978 | Fed. Rep. of Germany . | |
| 1291700 | 3/1962 | France | 272/130 |
| 2552671 | 4/1985 | France | 272/130 |

OTHER PUBLICATIONS

The Max Torso Builder pamphlet, published in 1984 by The Max Rice Corporation.

*Primary Examiner*—Richard J. Apley
*Assistant Examiner*—Franklin L. Gubernick
*Attorney, Agent, or Firm*—Graybeal, Jensen & Puntigam

[57] ABSTRACT

An exercise machine comprising a base, a horizontal turntable mounted on the base to rotate about a vertical axis, and two hydraulic assemblies each connecting the turntable to the base. The outboard portions of the hydraulic assemblies are mounted on upstanding base studs affixed to and spaced 2" inwardly from the rim of the base, using adjustable sleeves threadably engaging the outboard distal ends of the pistons of the hydraulic assemblies. The base studs are angled 72½° to either side of the support affixed to the base. The inboard ends of the hydraulic assemblies are affixed to studs depending from the turntable about 5" radially outwardly from the turntable's rotational axis. The turntable studs are positioned angularly 120° to either side of the center line of the turntable. The resistance against rotation of the turntable increases sinusoidally when the turntable's center line is 47½° away from the dead center position on the return stroke, and remains substantially constant from about 30° beyond dead center until the end of the outgoing stroke.

13 Claims, 2 Drawing Sheets

EXERCISE MACHINE WITH NON-LINEAR HYDRAULIC RESISTANCE

BACKGROUND OF THE INVENTION

1. Technical Field

This invention relates to exercise machines, and more particularly to exercise machines having a turntable rotated reciprocally by the user.

2. Description of the Prior Art

Exercise machines having turntables which are reciprocally rotated by the user are known. One of may earlier patents, Rice U.S. Pat. No. 4,538,807, the disclosure of which is incorporated herein by reference, describes a torso building exercise machine having an inertial resistance. By this it is meant that the resistance experienced by the user in rotating the turntable is produced by the turntable's rotational moment of inertia. The largest portion of the work performed by the user occurs at the end of each rotation as the user slows and then reverses the turntable's rotation. In the middle of the stroke the turntable rotates substantially resistance free, producing what may be termed a "dead spot" during which the user experiences little resistance.

Other turntable exercise machines having other forms of resistance have been developed. Phillips et al. U.S. Pat. No. 3,702,188 discloses a rotatable exerciser having a linear, hydraulically produced resistance. The user stands on a pair of rotatable members, each of which drives a pair of hydraulic cylinders through rack and pinion means. As each foot receiving member is reciprocally rotated, the pistons of its hydraulic cylinders are alternately and oppositely extended and retracted. At any angle of rotation of the foot receiving member, the resistance is linearly related to the rate of such rotation, and independent of the turntable's angular position.

Simjian U.S. Pat. No. 3,784,193 discloses a turntable exercise device having a friction brake resistance. The resistance provided by the Simjian device is constant, being substantially independent of both the turntable's angular position from dead center and the rate of rotation of the turntable.

Mattox U.S. Pat. No. 4,249,725 discloses an exercise apparatus having a gear driven spinning rotor which rotates many times during each stroke by the user. Resistance is provided both by the inertia of the spinning rotor and by the drag through the air of radially mounted paddles on the rotor. Like the Phillips et al device, the resistance of the Mattox exerciser is linear, being dependent on the rate of rotation of the rotor but independent of its angular position.

The Phillips et al., Simjian and Mattox devices all provide the same resistance in either direction.

SUMMARY OF THE INVENTION

It is an object of this invention to provide an exercise machine in which the resistance to rotation of a reciprocated turntable is non-linear, being dependent on both the turntable's angular position and the turntable's rate of rotation.

It is another object of this invention to provide an exercise machine in which the resistance to rotation in one direction may be greater or less than the resistance to rotation in the opposite direction.

It it yet another object of this invention to provide a turntable exercise machine in which the degree of resistance may be readily adjusted by the user.

It is a further object of this invention to provide an exercise machine with a non-linear resistance which may be readily engaged and disengaged by the user.

These and other objects are provided by an exercise machine having a rotatable turntable mounted on a stationary base means, and one or more resistance means mounted between the base means and the turntable. An outboard portion of each resistance means is pivotably mounted on the base means, and an inboard portion is pivotably mounted on the turntable inboardly of the outboard portion of the resistance means and outboardly of the turntable's axis of rotation. The resistance means resists longitudinal movement of one portion thereof relative to the other portion proportionally to the rate of such movement.

These and other objects are further accomplished by an exercise machine comprising a stationary base means, a rotatable member, and first and second resistance means mounted between the base means and the rotatable member. The rotatable member is mounted on the base means to rotate about an axis. Each of the resistance means has an outboard portion pivotably mounted on the base means. An inboard portion of each resistance means is pivotably mounted on the rotatable member inboardly of the outboard portion of the resistance means yet outboardly of the rotatable member's axis of rotation. Each of the resistance means resists longitudinal movement of one portion thereof relative to the other portion thereof proportionally to the rate of such longitudinal movement.

Other features and advantages of the present invention will become apparent from the following detailed description of typical embodiments thereof, taken in conjunction with the accompanying drawings.

DESCRIPTION OF THE PREFERRED EMBODIMENTS

Figure 1:
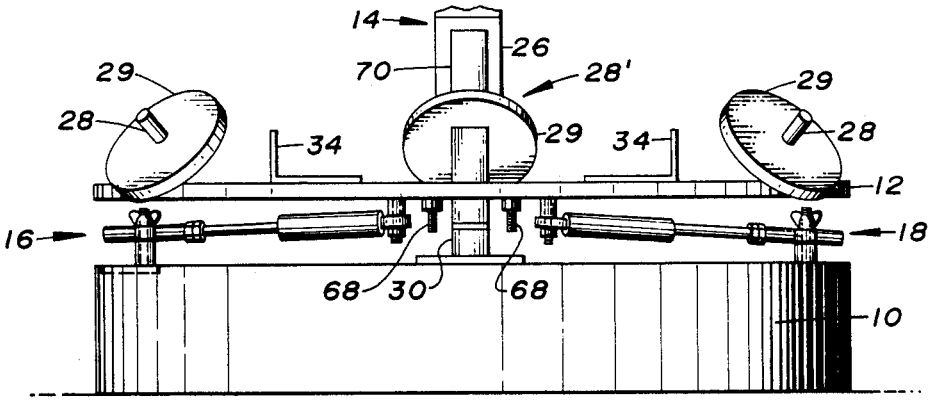
FIG. 1 is an isometric, partially fragmentary, detailed view of an exercise machine according to this invention, showing one of the hydraulic resistance means.

As best seen in FIG. 1, the exercise machine of this invention comprises a stationary base 10, a rotatable turntable 12, a handhold 14, and first and second hydraulic piston and cylinder assemblies 16, 18. The base 10 is floor mounted and comprises a circular rim 20 surrounding a T-shaped beam assembly. The beam assembly comprises a transverse beam 22 extending along a diameter of the circular rim, and a lateral beam 24 extending perpendicularly to the transverse beam along a radius of the rim. The ends of the transverse and lateral beams 22, 24 are affixed to the rim, such as by welding. The rim 20 is a circular band. The lateral beam 24 extends outwardly beyond the rim for a distance equal to about 40% of the radius of the rim. The handhold 14 comprises a stanchion 26 standing upwardly from the outboard end of the lateral beam 24, and gripping means (not shown) mounted on the stanchion. A suitable gripping means is disclosed in my earlier patent, Rice U.S. Pat. No. 4,538,807.

The turntable 12 suitably is a horizontal, generally circular metal disc about forty-eight inches (48") in diameter, mounted generally centrally of the rim 20 of the base 10. The lower surface of the turntable 12 is spaced upwardly about four inches (4") above the upper edge of the circular rim 20 and the upper surfaces of the beams 22, 24 of the base 10. The turntable is rotatable about a vertical axis through the center of the circular rim 20 of the base 10, thus having a single degree of freedom about an axis perpendicular to the turntable. Weight pegs 28 standing upwardly and outboardly around the periphery of the turntable 12 allow the optional addition of disc weights 29 to provide inertial resistance to the exercise machine.

The turntable 12 is positioned concentrically with the circular rim 20 of the base 10. A central axle 30 of the turntable 12 is journalled within a bearing 32 of the base 10. The bearing 32 is itself fixedly mounted at the center of the transverse beam 22. The axle 30 and bearing 32 provide the turntable 12 with a single degree of freedom about an axis perpendicular to the turntable, permitting it to rotate only about a vertical axis. The vertical axis of the turntable 12 is the reference axis for the angular positions and measurements of various elements of the exercise machine.

Several of the elements of the exercise machine are best described with reference to a dead center position of the turntable 12 relative to the base 10, and to center line C of the turntable. The turntable 12 is in its dead center position when it is exactly midway between strokes, in other words when the angular position of the turntable is centered between the opposite extreme angular positions of the turntable. The extreme angular positions of the turntable are determined by the configuration of the hydraulic assemblies 16, 18 described below or other resistance means, and by a braking system (not shown) which can be engaged to limit the rotation of the turntable. A cushioned braking system is disclosed in my earlier patent, Rice U.S. Pat. No. 4,538,807.

The center line C of the turntable 12 comprises the radius of the turntable which is perpendicular to the transversely outstretched arms of a person correctly positioned on the turntable. When the turntable 12 is at dead center, the turntable's centerline C is angularly aligned with the stanchion 26 of the handhold 14. In the exercise machine described herein, the turntable's centerline passes through one of the weight stanchions 28', which is angularly positioned on the turntable so that it is aligned directly over the lateral beam 24, and thereby aligned with the stanchion 26 of the handhold 14, when the turntable is at dead center. The other two weight spindles 28 are spaced symmetrically one hundred twenty degrees (120°) in either direction from the center weight spindle 28'.

The turntable 12 is provided with upstanding foot braces 34 for bracing the user on the turntable. The foot braces 34 are spaced between the two non-center weight spindles 28, and are aligned substantially perpendicular to the chord between those weight spindles and thus substantially parallel to the centerline C of the turntable 12. The foot braces 34 in combination with the handhold 14 provide a two point anchoring of the user's lower extremities on the turntable 12. The handhold 14 provides a multi-point anchoring of the upper extremities. In combination, the handhold 14 and foot braces 34 allow the user to exercise on the turntable confidently, without fear of slipping.

The non-linear resistance of this invention is provided by the hydraulic assemblies 16, 18 extending between the base 10 and the turntable 12. The hydraulic assemblies 16, 18 resist rotation of the turntable, forcing the user to work in order to rotate the turntable alternately in clockwise and counterclockwise strokes. The hydraulic assemblies 16, 18 are themselves conventional. For ease of supply and replacement, the presently preferred hydraulic assemblies 16, 18 comprise conventional automotive shock absorbers, such as Model NO. 80F-2307 shocks made by KONI of Holland.

Figure 2:
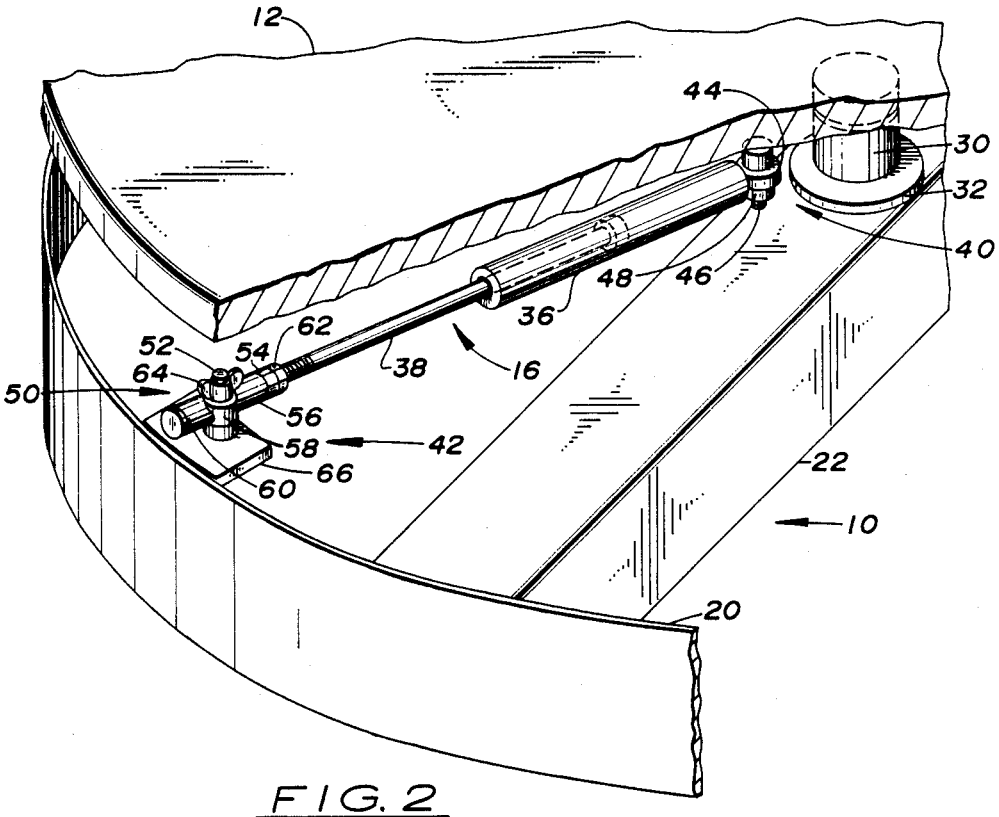
FIG. 2 is a rear elevational view of the exercise machine of FIG. 1 showing the base, turntable, and handhold.

As best seen in FIG. 2, the hydraulic assemblies 16, 18 are mounted between the turntable 12 and the base 10 so that reciprocal rotation of the turntable causes the hydraulic assemblies to alternately lengthen and shorten. Each of the hydraulic assemblies 16, 18 comprises a cylinder 36 and a piston 38 extending through an aperture in one end of the cylinder. The opposite end of the cylinder 36 is pivotably mounted on the underside of the turntable about five inches (5") radially outboardly from the turntable's axis of rotation. This pivotably mounted end of the cylinder 36 will be referred to as the inboard end 40 of the hydraulic assembly 16 or 18.

From this inboard end, each hydraulic assembly 16, 18 extends generally outboardly away from the turntable's vertical axis to the hydraulic assembly's outboard end 42 which is pivotably mounted on the base 10. The outboard end 42 comprises the distal end of the piston 38 of each of the hydraulic assemblies 16, 18. The terms "inboard" and "outboard" are used herein to refer to relative radial distances from the turntable's axis of rotation. Thus, the inboard ends 40 of the hydraulic assemblies 16, 18 are relatively closer to the turntable's axis than the outboard ends 42.

The closed ends of the cylinders 36 terminate in transverse mounting means for mounting said ends of the assemblies. The transverse mounting means is provided as part of the off-the-shelf automotive shock absorbers identified above. The transverse mounting means comprises a cylindrical resilient bushing 44 attached with its longitudinal axis perpendicular to the long axis of the cylinder 36. The resilient bushing 44 is held between inner and outer concentric cylindrical metal sleeves. One side of the outer metal sleeve of the bushing 44 is welded to the closed end of the cylinder 36. Thus, the axial opening defined within the inner sleeve of the resilient bushing 44 is transverse to the long axis of the cylinder 36.

The resilient bushing 44 receives and is pivotably mounted on a turntable stud 46 extending downwardly from the turntable 12. The turntable stud 46 is a one-half inch (½") diameter, three and one-half inches (3½") long bolt welded at its smooth end to the underside of the turntable 12. The turntable stud 46 is slidably received within the axial interior opening of the resilient bushing 44. A three quarter inch (¾") thick metal spacer washer is placed around the turntable stud 46 between the resilient bushing 44 and the turntable 12. The bushing 44 at the inboard end of the hydraulic assembly is held on the turntable stud 46 by a conventional nut 48 threadably engaging the threaded free end of the stud. The axial opening through the bushing 44 allows the cylinder 36 to pivot about the long axis of the turntable stud 46. The resiliency of the bushing 44 allows the cylinder 36 to flex a small amount vertically.

Because the hydraulic assemblies 16, 18 are conventional off-the-shelf components, their interior working components will not be described in detail. Rather, the operational characteristics of the hydraulic assemblies 16, 18 will be specified. The hydraulic assemblies 16, 18 are unidirectional, non-loaded automotive shock absorbers. They are unidirectional in that they resist only lengthening, having negligible resistance to shortening. They are non-loaded in the sense that they are not biased toward lengthening or shortening, but instead will passively remain at whatever length they are set to.

The piston 38 of each of the hydraulic assemblies 16, 18 extends beyond the closed cylinder 36 through an aperture in the end of the cylinder opposite the resilient bushing 44. The piston 38 extends a maximum of ten inches (10") beyond the apertured end of the cylinder 36. When installed in the exercise machine of this invention as described below, the piston travels about eight inches (8"), thereby leaving a margin for adjustment of the hydraulic assembly. The piston comprises a seven-sixteenths inch (7/16") diameter solid metal rod. About one and one-half inches (1½") of the distal end of the piston 38 are threaded.

A sleeve 50 threadably engaging the distal end of each piston 38 pivotably mounts said end of the piston on an upstanding base stud 52 rigidly attached near the rim 20 of the base 10. As best seen in FIG. 2, the sleeve 50 comprises a nut 54 for threadably engaging the distal end of the piston 38, a first pipe section 56 affixed coaxially at one end to said nut, a thick washer 58 affixed transversely at one side to the opposite end of the first pipe section 56, and a second, shorter pipe section 60 affixed to the opposite side of the washer 58 coaxially with the longer, first pipe section 56. The first pipe section 56 is welded at its inboard end around the periphery of one flat side of the nut 54. When the nut 54 is threaded onto the piston 38, the distal end of the piston extends through the nut 54 into the interior volume of the first pipe section 56. The first pipe section 56 has an outside diameter of five-eighths inch (⅝"), an inside diameter of one-half inch (½"), and is about one and three-eighths inches (1⅜") long to accept the threaded distal end of the piston 38 within the nut 54 and the first pipe section 56. A lock nut 62 is threaded onto the piston 38 before the sleeve 50, and is moved into proximal contact with the nut 54 to hold the sleeve in position after adjustment of the sleeve.

Washer 58 is welded transversely to the opposite, outboard end of the first pipe section 56. The washer 58 has an outside diameter of one and one-half inches (1½"), an inside diameter of nine-sixteenths inch (9/16"), and is about five-eighths inch (⅝") thick. The washer 58 is welded at one side of its cylindrical outer surface to the outboard end of the first pipe section 56, which is profiled to smoothly join the surface of the washer. Thus, the axis through the interior hole of the washer 58 is transverse to the long axis of the first pipe section 56. The second, shorter pipe section 60 is profiled and welded in like manner to the opposite, outboard side of the exterior surface of the washer 58. The second pipe section 60 has the same inside and outside diameter as the first pipe section 56, but is only about one inch (1") long. This second pipe section 60 is left open at its outboard end to allow the user to insert a finger therein to readily manipulate the sleeve 50 when it is attached to the piston 38.

The washer 58 of the sleeve 50 slides over the upstanding base stud 52, and is retained thereon by a conventional threaded wing nut 64. The base stud 52 is two and one-half inches (2½") long, and has an outside diameter of nine-sixteenths inch (9/16") at its lower, proximal end. The upper, distal end of the base stud 52 is threaded to an outside diameter of one-half inch (½"). The base stud 52 is carried on an angle element 66 affixed to and extending inwardly from the rim 20 of the base 10. The angle element 66 is a two inch by two inch by one-quarter inch (2"×2"×¼") standard steel angle having one portion welded to the upstanding circular rim 20, and having a second perpendicular portion aligned horizontally flush with the upper edge of the rim 20 and extending inwardly therefrom. The lower, proximal end of the base stud 52 is welded to the inward distal end of this inwardly extending portion of the angle element 66. The longitudinal axis of the base stud is oriented vertically and spaced about one and three-quarters inches (1¾") inboardly from the exterior surface of the circular rim 20 of the base 10.

The angular positions of the inboard and outboard ends 40, 42 of the hydraulic assemblies 16, 18 relative to the dead center position of the turntable 12 are selected to provide an optimal pattern of resistance to rotation of the turntable 12 by the user. The resistance produced by the hydraulic assemblies 16, 18 is best described by comparison with the resistance provided by a purely inertial turntable. When operating a purely inertial turntable, the user must exert maximum effort at the end of each stroke in stopping and then reversing the rotation of the weighted turntable 12. Thus, the inertial resistance pattern is maximized at the end of the stroke, and minimized as the turntable 12 passes through its dead center position.

The non-linear hydraulic resistance pattern provided by the hydraulic assemblies 16, 18 positioned as described herein complements the inertial resistance pattern provided by the weights 29 around the periphery of the turntable 12. As the user rotates the turntable 12 from either extreme angular position toward dead center at the beginning of a stroke, the resistance builds gradually beginning forty seven and one-half degrees (47½°) before the turntable crosses dead center. The resistance substantially levels off about thirty degrees (30°) after the turntable 12 crosses dead center, and remains substantially at that level until the end of the stroke, when the user begins slowing the turntable in preparation for another stroke in the opposite direction. The resistance pattern of the exercise machine of this invention requires the user to work to push the turntable 12 past dead center, thus filling in the dead spot of the inertial resistance.

The first and second hydraulic assemblies 16, 18 provide resistance means for resisting longitudinal movement of one portion of the resistance means relative to its other portion proportionally to the rate of such longitudinal movement. This proportionality is a characteristic of both hydraulic and pneumatic piston and cylinder assemblies. The hydraulic assemblies 16, 18 provide resistance dependent on the rate of rotation of the turntable.

The resistance is non-linear in that the intensity or degree of resistance varies depending on the angular position of the turntable. In a given stroke, clockwise or counterclockwise, the resistance is insignificant until the turntable is forty seven and one-half degrees (47½°) away from dead center. Beyond that point the resistance increases sinusoidally, leveling off when the turntable 12 is about thirty degrees (30°) past dead center. As the resistance provided by one of the hydraulic assemblies decreases sinusoidally beyond this thirty degree (30°) position, the other hydraulic assembly's resistance increases sinusoidally, so that the user experiences substantially constant resistance through to the end of the stroke. The non-linearity thus occurs between forty seven and one-half degrees (47½°) before and about thirty degress (30°) beyond dead center. The operation of the exercise machine is described in detail next.

The non-linear resistance to rotation of the turntable 12 is provided by mounting two hydraulic assemblies 16, 18 between the base 10 and the turntable 12 in such a manner that the resistance is dependent on the angular position of the turntable. The outboard portions 42 of the hydraulic assemblies, herein comprising the sleeves 54 at the distal end of the pistons 38, are pivotably mounted on the base 10, herein on the base studs 52 affixed to the rim 20. The inboard portions 40 of the hydraulic assemblies, herein comprising the closed ends of the cylinder 36 and the resilient bushings 44 affixed thereto, are pivotably mounted on the turntable 12, herein on the turntable studs 46, outboardly of the turntable's axis of rotation yet inboardly of the hydraulic assemblies' outboard portion 42. The inboard portions 40 of the hydraulic assemblies 16, 18, follow circular paths around the turntable's axis as the turntable 12 is rotated, thereby acting as eccentrics relative to the stationary base studs 52.

The angular and radial positions of the turntable studs 46 and the base studs 52 are symmetrical about the plane defined by the axis of rotation of the turntable 12 and the angular position of the handhold 14, i.e. about the vertical plane through the centerline C of the turntable when the turntable is at dead center. As described above, the base studs 52 are spaced inwardly two inches (2″) on center from the exterior surface of the rim 20 of the base 10. The angular positions of the base studs 52, measured about the turntable's vertical axis, are seventy two and one-half degrees (72½°) in either direction from the handhold 14 which defines the dead center position of the turntable 12. Thus, the base studs 52 are separated by a one hundred forty five degree (145°) angle about the turntable's vertical axis, said angle being bisected by the handhold 14.

The turntable studs 46 are spaced radially outwardly from the turntable's axis five inches (5″) on center, and are positioned angularly one hundred twenty degrees (120°) in either direction from the centerline C of the turntable 12. Thus, the turntable studs 46 are separated from each other by an angle of 240°, said angle being bisected by the centerline C of the turntable 12. It will be seen that the turntable studs 46 are aligned angularly with the two non-center weight spindles 28 described above.

Figure 3:
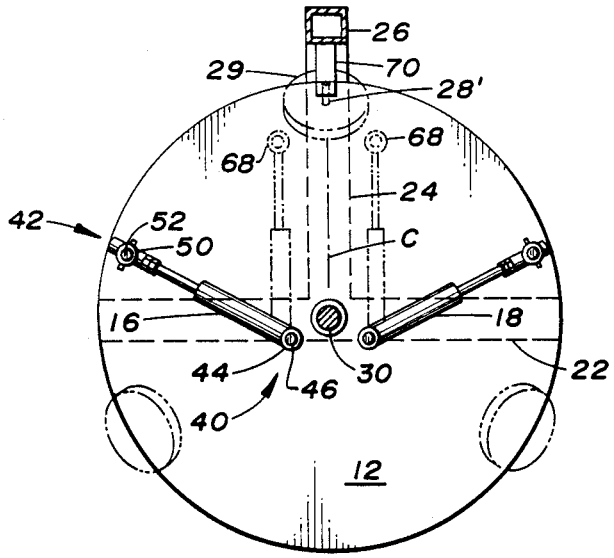
FIG. 3 is a top plan view looking down on the exercise machine of FIGS. 1 and 2, with the turntable in its dead center position.
Figure 4:
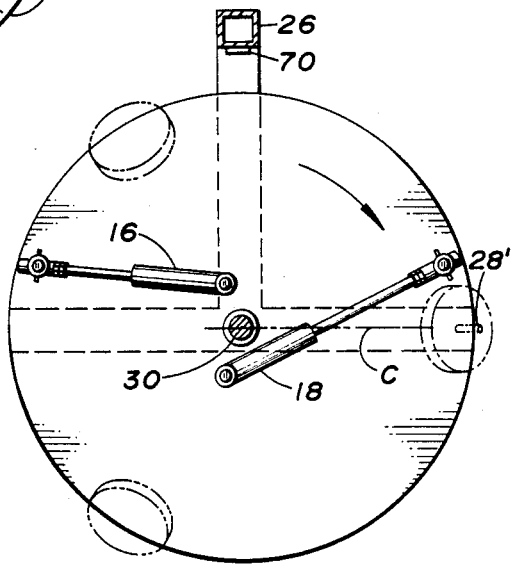
FIG. 4 is a top plan view looking down on the exercise machine of FIG. 3 at the end of a clockwise stroke.
Figure 5:
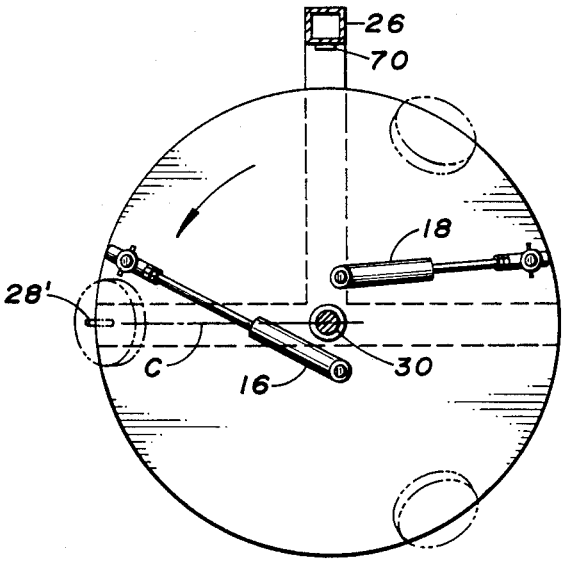
FIG. 5 is a top plan view looking down on the exercise machine of FIG. 3 at the end of a counterclockwise stroke.

The operation of the exercise machine of this invention, and the non-linear resistance provided to the turntable 12 by the hydraulic assemblies 16, 18, are best described with reference to FIGS. 3–5. FIG. 3 shows the turntable 12 in the dead center position, with the hydraulic assemblies 16, aligned symmetrically at either side of the vertical plane through the centerline C of the turntable and through the handhold 14. As the user grips the handhold 14 and rotates the turntable 12 clockwise from dead center as shown in FIG. 4, the first hydraulic assembly 16 shortens and provides no resistance, while the second hydraulic assembly 18 lengthens and thus resists the user's effort. The turntable stud 46 of the second hydraulic assembly 18 follows an arc about the turntable's axis at a radius of five inches (5″). When the turntable has been rotated clockwise about thirty degrees (30°) from dead center, the long axis of the second hydraulic assembly 18 is tangent to the arc described by its turntable stud 46, and the resistance provided by the second hydraulic assembly 18 is at a maximum. Beyond thirty degrees (30°) clockwise rotation from dead center the resistance of the second hydraulic assembly 18 decreases sinusoidally. While the second hydraulic assembly 18 is approaching and passing through its position of maximum resistance at thirty degrees (30°) of rotation, the first hydraulic assembly 16 is shortening and thus providing substantially no resistance.

During a clockwise stroke the first hydraulic assembly 16 does not begin to lengthen and resist the user's efforts until the turntable has been rotated forty seven and one-half degrees (47½°) clockwise beyond dead center, when the turntable stud 46 at the inboard end 40 of the first hydraulic assembly reaches the angular position of the base stud 52 at the outboard end 42 of the first hydraulic assembly. Beyond forty seven and one-half degrees (47½°) clockwise rotation, the first hydraulic assembly 16 begins to lengthen, and the resistance provided by the first hydraulic assembly 16 increases sinusoidally, reaching about seventy percent (70%) of its maximum when the turntable has been rotated an additional forty five degrees (45°), i.e. when the turntable 12 is positioned slightly more than ninety degrees (90°) clockwise from dead center, at which point the resistance provided by the second hydraulic assembly 18 has diminished to about thirty percent (30%) of its theoretical maximum. The resistance developed by the first hydraulic assembly 16 reaches a theoretical maximum when the turntable has been rotated one hundred thirty seven degrees (137½°) clockwise beyond dead center. However before this point is reached, the second hydraulic assembly 18 will have reached its maximum extension, preventing further clockwise rotation of the turntable 12. The extreme angular positions limiting rotation of the turntable 12 are effectively about ninety degrees to one hundred twenty degrees (90°–120°) in either direction from dead center.

At the end of a stroke, the user must slow and stop the turntable 12, and start it rotating in the opposite direction. Because the hydraulic assemblies 16, 18 resist movement of the turntable 12 away from dead center, they assist the user in slowing and stopping the turntable 12 at the end of a stroke. As the user begins a new stroke, starting the turntable 12 from its extreme angular position toward dead center, both hydraulic assemblies 16, 18 shorten and do not resist the user until the turntable 12 is forty seven and one-half degrees (47½°) from dead center. In a counterclockwise stroke, at forty seven and one-half degrees (47½°) from dead center, the first hydraulic assembly 16 begins to lengthen and resist the user, while the second hydraulic assembly 18 continues to shorten. By the time the turntable 12 crosses dead center rotating counterclockwise, the first hydraulic assembly 16 is producing over seventy percent (70%) of its maximum possible resistance.

Because the hydraulic assemblies 16, 18 are arranged symmetrically about either side of the vertical plane through the handhold 14 and the centerline of the turntable 12 when positioned at dead center, the resistance provided by the exercise machine is also symmetrical to either side of said plane. Thus, as the user rotates the turntable 12 counterclockwise beyond dead center, he or she experiences the same degree of resistance described above with respect to rotation of the turntable 12 clockwise form dead center, but with the contributions of the first and second hydraulic assemblies reversed.

The exercise machine of this invention may be used in three modes: with purely hydraulic resistance developed by the hydraulic assemblies 16, 18; with combined hydraulic and inertial resistance by adding the weights 29 to the weight spindles 28; and with purely inertial resistance by disengaging the hydraulic assemblies 16, 18 and using only the weights 29. To disengage the hydraulic assemblies 16, 18, the washers 58 of the sleeves 50 at the outboard ends 42 of the hydraulic assemblies 16, 18 are lifted off their respective base studs 52, and slipped over holding studs 68 affixed to the underside of the turntable 12, and retained thereon by the wing nuts 64. With their sleeves 50 carried on the holding studs 68 of the turntable 12, the hydraulic assemblies 16, 18 are disengaged from the base 10 and rotate freely with the turntable, providing no hydraulic resistance.

The holding studs 68 comprise two inch (2") long bolts welded at their proximal ends to the underside of the turntable 12. The holding studs 68 are angularly positioned closely adjacent each other at opposite sides of the centerline C of the turntable 12, spaced about two inches (2") inwardly from the perimeter of the turntable. The holding studs 68 are threaded along about one-half inch (½") of their distal ends to receive the wing nuts 64. The sleeves 50 of the hydraulic assemblies 16, 18 are retained on the holding studs 68 by slipping the washers 62 of the sleeves over the holding studs 68 and retaining them thereon by threading the wing nuts 64 onto the distal ends of the holding studs. Thus disengaged, the hydraulic assemblies 16, 18 form a narrow V-shape with the projected apex thereof aligned with the centerline C of the turntable 12.

Locking means is provided to facilitate the user's stepping on and off the turntable 12. The locking means comprises an L-shaped locking member 70 hingedly mounted on the stanchion 26, and adapted to engage the center weight spindle 28' of the turntable 12 when the turntable is in its dead center position. The end of the longer portion of the locking member 70 is attached horizontally to the stanchion as by a piano hinge. The shorter portion of the locking member 70 extends downwardly from the end of the locking member. A notch in the distal end of the depending lower portion of the locking member is adapted to receive the center weight spindle 28'. When the turntable is to be locked against rotation, the locking member 70 is lifted, the turntable 12 is placed in its dead center position, and the locking member 70 is lowered over the center weight spindle 28', thereby preventing rotation of the turntable in either direction. When the locking means is disengaged, the locking member 70 is dropped flat against the stanchion 26, out of the way of the rotating turntable 12.

The hydraulic assemblies 16, 18 preferably provide the user with means for adjusting their degrees or intensities of resistance. The automotive shock absorbers specified above do provide such adjustment means. The degree of resistance of each of the hydraulic assemblies 16, 18 is adjusted by longitudinally rotating the piston 38 relative to the cylinder 36. Rotation of the piston 38 in one direction progressively decreases the resistance of the hydraulic assembly, while rotation in the opposite direction increases the degree of resistance. Thus, the exercise machine of this invention can accommodate both a novice user initially requiring reduced resistance, and an experienced, conditioned user capable of working against significantly greater resistance.

The resistances of the hydraulic assemblies 16, 18 can be set differentially, with one assembly having a greater degree of resistance than the other, so that the turntable 12 will be harder to rotate in one direction than in the other. This could have therapeutic value in rehabilitating a person having a differential disability affecting one side of his or her body more than the other.

It will be appreciated that although the configuration of the two hydraulic assemblies 16, 18 described above produces a hydraulic resistance which optimally complements the inertial resistance of the turntable 12, other configurations of the hydraulic assemblies may be used to produce other desirable resistance patterns. For example, it has been found that two unidirectional hydraulic resistances affixed at their inboard ends to the turntable and at their outboard ends to the base and aligned radially from the axis of the turntable, produce a resistance which increases sinusoidally from the dead center position to maximum resistance when the turntable is rotated ninety degrees (90°) to either side of dead center, while providing a "free ride" back from this extreme position to dead center on the return stroke. With this configuration, the user must exert a maximum effort at the end of each stroke.

In another configuration, with two unidirectional resistance means having their outboard ends pivotably mounted near the rim about fifty degrees (50°) to either side of the handhold 14, and their inboard ends pivotably mounted one hundred thirty five degrees (135°) to either side of the center line C of the turntable 12, the resistance increases sinusoidally from zero resistance at the beginning of the stroke to a maximum as the turntable crosses dead center, and decreases sinusoidally beyond dead center to zero at the end of the stroke.

In another alternative embodiment, resistance means for resisting both lengthening and shortening are used in place of the hydraulic assemblies described above which resist only lengthening. Using such bidirectional resistance means, the "free ride" provided by certain configurations of the resistance means can be eliminated, producing symmetrical resistance patterns on both the outgoing and return strokes.

It will be appreciated that the resistance provided by this invention, and particularly the resistance patterns available using two resistance means, may be applied not only to an exercise machine having a turntable rotating about a vertical axis, but also to any exercise machine in which the user's effort rotates a rotational member relative to a base. Almost any motion produced by an exercising person can be readily converted to reciprocal rotational movement of a rotational member relative to a fixed base. By providing two hydraulic, pneumatic or equivalent resistance means, with the outboard portions thereof pivotably mountable at any selected one of two or more angular positions on the base, and the inboard portions of said resistance means pivotably mountable at any selected one of two or more angular positions on the rotational member, said inboard portions of the resistance means being located outboardly of the rotational member's axis of rotation yet inboardly of the outboard portion of the respective resistance means, an exercise machine will be produced which, by appropriately selecting the mounting points of the resistance means, can be adapted to provide many different resistance patterns as desired or required by the individual users of the machine.

It will be appreciated that, although specific embodiments of this invention have been described herein for purposes of illustration, various modifications may be made without departing from the spirit and scope of the invention. Accordingly, the scope of the invention is not limited except as by the following claims.

I claim:

1. An exercise machine, comprising:

a stationary base means;

a rotatable turntable mounted on said base means, said turntable having a single degree of freedom about an axis perpendicular thereto; and plural resistance means, each having an outboard portion pivotally mounted on the base means, and an inboard portion pivotably mounted on the turntable inboardly of the outboard portion and outboardly of the turntable's axis, said resistance means resisting longitudinal movement of one portion thereof relative to the other portion proportionally to the rate of such movement, with rotation of said turntable causing said longitudinal movement, said resistance means comprising two hydraulic cylinders interconnected between said base means and said turntable in a manner permitting rotation of the turntable relative to the base in each direction up to about 120° from a dead center position, said hydraulic cylinders each having a unidirectional loading action and being arranged to effect relatively little loading on rotation of the turntable as the turntable moves from either extreme toward positions about 45° away from dead center and to effect relatively greater loading on rotation of the turntable through positions of the turntable within about 45° of dead center.

2. An exercise machine according to claim 1, wherein the hydraulic cylinders comprise a pair of like automotive shock absorbers.

3. An exercise machine according to claim 1, wherein the degree of resistance of each resistance means is adjustable.

4. An exercise machine according to claim 1, further including handhold means in fixed location above and at one side of the base means.

5. An exercise machine comprising:

a stationary base means;

a horizontal, generally circular rotatable turntable mounted generally centrally of said base means, said turntable having a single degree of freedom about its vertical axis;

rigid handhold means in fixed location relative to the base means above and at one side of the turntable so as to be grasped by a person exercising with feet placed on the turntable and rotating the turntable back and forth; and first and second hydraulic resistance means, each having an outboard portion pivotably mounted on the base means, and an inboard portion pivotably mounted on the underside of the turntable inboard of the outboard portion and outboard of the turntable's vertical axis, said resistance means resisting longitudinal movement of one portion thereof relative to the other portion proportionally to the rate of such movement, with rotation of said turntable causing said longitudinal movement.

6. An exercise machine according to claim 5, wherein the inboard portions of the hydraulic resistance means are respectively pivotably mounted on the turntable about one hundred twenty degrees (120°) in opposite directions about the turntable's vertical axis from the dead center position of the turntable; and the outboard portions of the resistance means are respectively pivotably mounted on the base about seventy-two and one-half degrees (72½°) in opposite directions about the turntable's vertical axis from the turntable's position when the turntable is in a dead center position; and the resistance means resist only lengthening.

7. An exercise machine according to claim 6, wherein the inboard portions of the resistance means are spaced radially outboardly about five inches (5″) from the turntable's vertical axis.

8. An exercise machine according to claim 6, wherein the outboard portions of the resistance means are spaced radially inboardly about two inches (2″) from a rim of the base means.

9. An exercise machine, comprising;

a stationary base means having a generally circular rim;

a horizontal, generally circular rotatable turntable mounted generally centrally of said base means, said turntable having a single degree of freedom about its vertical axis;

handhold means substantially immovable above and at one side of the base means; and first and second hydraulic assemblies, each such assembly including a piston having an outboard end pivotably mounted on the rim of the base means, and a cylinder receiving an inboard end of the piston, said cylinder having an inboard end pivotably mounted on the underside of the turntable inboardly of the piston's outboard end and outboardly of the turntable's vertical axis, the hydraulic assembly resisting longitudinal movement of the piston within the cylinder proportionally to the rate of such movement, with rotation of said turntable causing said longitudinal movement, the inboard ends of the cylinders being respectively pivotably mounted on the turntable about one hundred twenty degrees (120°) in opposite directions about the turntable's vertical axis from the dead center of the turntable; and the outboard portions of the pistons being respectively pivotably mounted on the rim about seventy-two and one-half degrees (72½°) in opposite directions about the turntable's vertical axis from the turntable's position when the turntable is in a dead center position; and the hydraulic assemblies being constructed to resist only lengthening.

10. An exercise machine according to claim 9, wherein the inboard ends of the cylinders are spaced radially outboardly about five inches (5″) from the turntable's vertical axis.

11. An exercise machine according to claim 9, wherein the outboard ends of the pistons are spaced radially inboardly about two inches (2″) from the rim of the base means.

12. An exercise machine according to claim 9, wherein the outboard ends of the pistons are removably mounted on the rim; and further including means for carrying the outboard ends of the pistons on the turntable.

13. An exercise machine according to claim 9, further including locking means for locking the turntable against rotation.

* * * * *